US005412288A

United States Patent [19]

Borowiec et al.

[11] Patent Number: 5,412,288

[45] Date of Patent: May 2, 1995

[54] AMALGAM SUPPORT IN AN ELECTRODELESS FLUORESCENT LAMP

[75] Inventors: Joseph C. Borowiec, Schenectady; John P. Cocoma, Clifton Park, both of N.Y.

[73] Assignee: General Electric Company, Schenectady, N.Y.

[21] Appl. No.: 166,857

[22] Filed: Dec. 15, 1993

[51] Int. Cl.[6] ..... H05B 41/16

[52] U.S. Cl. ..... 315/248; 313/160; 313/490; 313/493; 315/344

[58] Field of Search ..... 315/248, 344; 313/153, 313/160, 161, 488, 490, 491, 577, 549, 492, 493, 634

[56] References Cited

U.S. PATENT DOCUMENTS

| | | | |
|---|---|---|---|
| 4,010,400 | 3/1977 | Hollister | 315/248 |
| 4,105,910 | 8/1978 | Evans | 313/490 |
| 4,262,231 | 4/1981 | Anderson et al. | 313/490 |
| 4,437,041 | 3/1984 | Roberts | 315/248 |
| 4,539,508 | 9/1985 | Mulder et al. | 313/490 |
| 4,622,495 | 11/1986 | Smeelen | 315/248 |

*Primary Examiner*—Anita Pellman Gross
*Assistant Examiner*—Walter Malinowski
*Attorney, Agent, or Firm*—Jill M. Breedlove; Marvin Snyder

[57] ABSTRACT

An electrodeless SEF fluorescent discharge lamp of the type having an envelope with a re-entrant cavity formed therein for containing an excitation coil includes an amalgam positioned for maintaining an optimum mercury vapor pressure during lamp operation. An exhaust tube extending through the re-entrant cavity has an extension into the envelope toward the apex of the lamp envelope. The exhaust tube extension has a rim portion for holding an amalgam support in position within the lamp envelope. The amalgam support preferably comprises a wire wrapped about and held in place by the rim portion. At the other end of the wire, an amalgam is wetted to a wire screen or helical wire structure at a predetermined optimal location within the lamp envelope. Alternatively, two amalgams are supported by the amalgam support at predetermined optimal locations for starting and steady-state operation of the lamp, respectively.

11 Claims, 3 Drawing Sheets

AMALGAM SUPPORT IN AN ELECTRODELESS FLUORESCENT LAMP

FIELD OF THE INVENTION

The present invention relates generally to electrodeless fluorescent lamps and, more particularly, to placement and support of an amalgam in such a lamp for controlling mercury vapor pressure therein.

BACKGROUND OF THE INVENTION

The optimum mercury vapor pressure for production of 2537 Å radiation to excite a phosphor coating in a fluorescent lamp is approximately six millitorr, corresponding to a mercury reservoir temperature of approximately 40° C. Conventional tubular fluorescent lamps operate at a power density (i.e., typically measured as power input per phosphor area) and in a fixture configuration to ensure operation of the lamp at or about a mercury vapor pressure of six millitorr (typically in a range from approximately four to seven millitorr); that is, the lamp and fixture are designed such that the coolest location (i.e., cold spot) of the fluorescent lamp is approximately 40° C. Compact fluorescent lamps, however, including electrodeless solenoidal electric field (SEF) fluorescent discharge lamps, operate at higher power densities with the cold spot temperature typically exceeding 50° C. As a result, the mercury vapor pressure is higher than the optimum four to seven millitorr range, and the luminous output of the lamp is decreased.

One approach to controlling the mercury vapor pressure in an SEF lamp is to use an alloy capable of absorbing mercury from its gaseous phase in varying amounts, depending upon temperature. Alloys capable of forming amalgams with mercury have been found to be particularly useful. The mercury vapor pressure of such an amalgam at a given temperature is lower than the mercury vapor pressure of pure liquid mercury.

Unfortunately, accurate placement and retention of an amalgam to achieve a mercury vapor pressure in the optimum range in an SEF lamp are difficult. For stable long-term operation, the amalgam should be placed and retained in a relatively cool location with minimal temperature variation. Moreover, to achieve the desired beneficial effects of an amalgam in an SEF lamp, the amalgam should maintain its composition and optimized location during lamp processing and manufacturing steps as well as during lamp operation.

Commonly assigned U.S. Pat. No. 4,262,231 of Anderson et al., issued Apr. 14, 1981, which is incorporated by reference herein, describes situating a lead-tin-bismuth amalgam in an electrodeless SEF fluorescent lamp by wetting the amalgam to a metal wire structure, such as a helix structure or a cylindrical screen, which is fixed within the tip-off region of a lamp envelope. Alternatively, Anderson et al. describe melting the amalgam onto an indium-coated, phosphor-free portion of the interior surface of the lamp envelope.

Smeelen U.S. Pat. No. 4,622,495 describes another scheme for locating an amalgam within an electrodeless SEF fluorescent lamp by attaching an amalgam holder to a tubular indentation (hereinafter referred to as a re-entrant cavity) within the lamp envelope. Disadvantageously, this requires a glass-to-metal seal; and a reliable glass-to-metal seal is difficult to achieve in manufacturing.

Accordingly, it is desirable to provide an easy-to-manufacture support for an amalgam in an electrodeless SEF fluorescent discharge lamp which provides an optimal operating location for the amalgam, while not requiring a glass-to-metal seal. Such a support should fix the location of the amalgam during lamp manufacturing steps as well as during lamp operation.

SUMMARY OF THE INVENTION

An electrodeless SEF fluorescent discharge lamp of the type having an envelope with a re-entrant cavity formed therein for containing an excitation coil includes an amalgam positioned for maintaining an optimum mercury vapor pressure during lamp operation. An exhaust tube extending through the re-entrant cavity has an extension into the envelope toward the apex of the lamp envelope. The exhaust tube extension has a rim portion for holding an amalgam support in position within the lamp envelope. The amalgam support preferably comprises a wire wrapped about and held in place by the rim portion and the re-entrant cavity. At the other end of the wire, an amalgam is wetted to a wire screen or helical wire structure at a predetermined optimal location within the lamp envelope.

In one embodiment, two amalgams are supported by the amalgam support at predetermined optimal locations for starting and steady-state operation of the lamp, respectively.

BRIEF DESCRIPTION OF THE DRAWINGS

The features and advantages of the present invention will become apparent from the following detailed description of the invention when read with the accompanying drawings in which.

Figure 3:
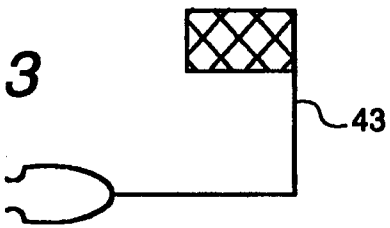
Figure 5:
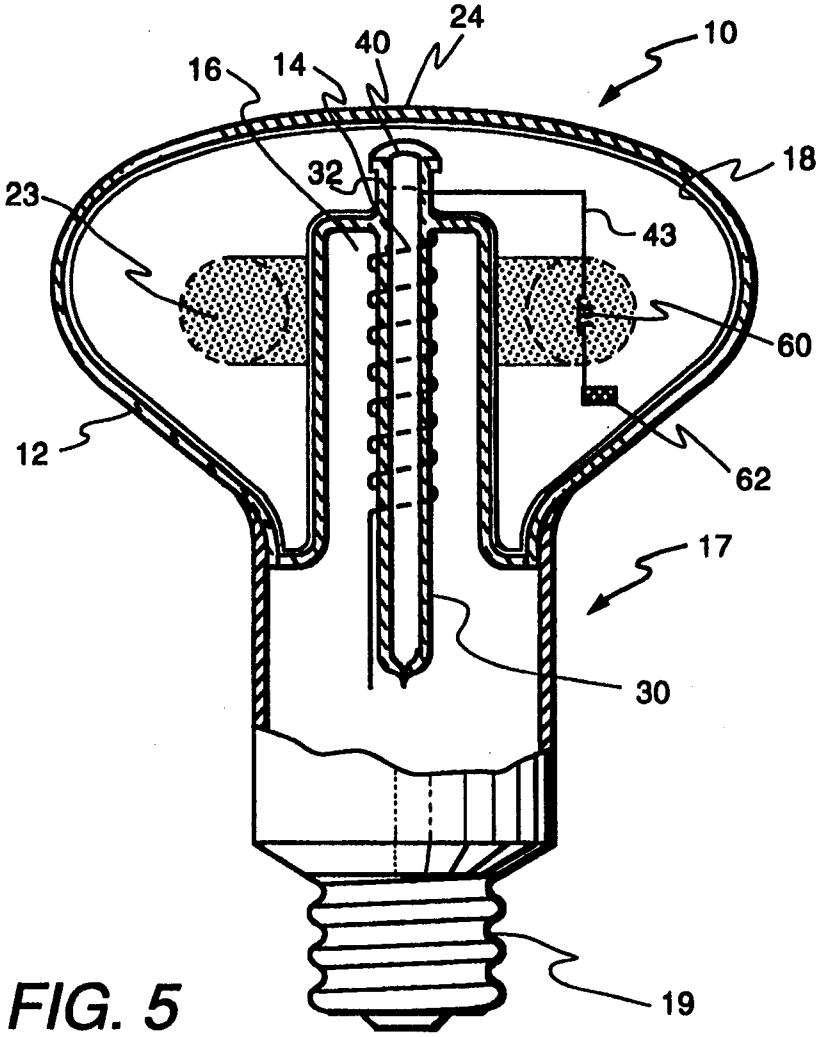
Figure 4:
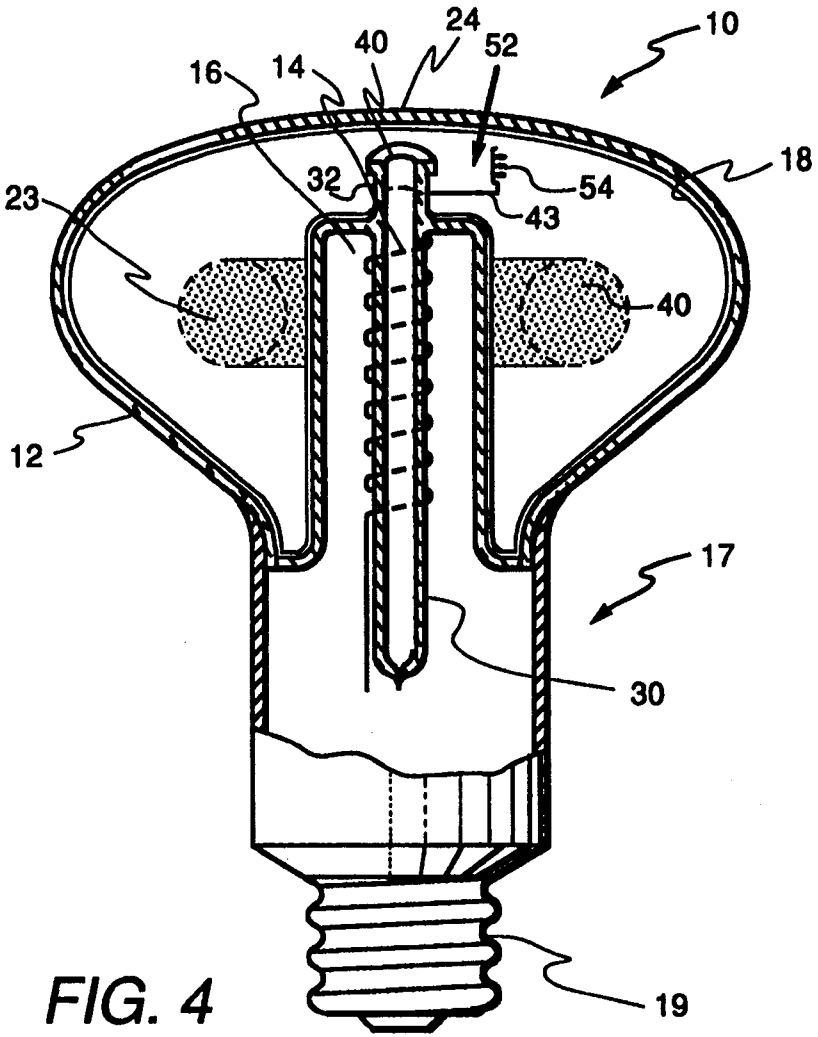

FIG. *2a* illustrates, in partial cross section, an electrodeless SEF fluorescent lamp including an amalgam supported within the lamp in accordance with the present invention;

FIG. *2b* shows the exhaust tube and amalgam support of FIG. *2a* in more detail;

FIG. 3 illustrates an alternative embodiment of an amalgam support according to the present invention;

FIG. 4 illustrates, in partial cross section, an alternative embodiment of an electrodeless SEF fluorescent lamp in accordance with the present invention; and FIG. 5 illustrates, in partial cross section, another alternative embodiment of an electrodeless SEF fluorescent lamp in accordance with the present invention.

DETAILED DESCRIPTION OF THE INVENTION

Figure 1:
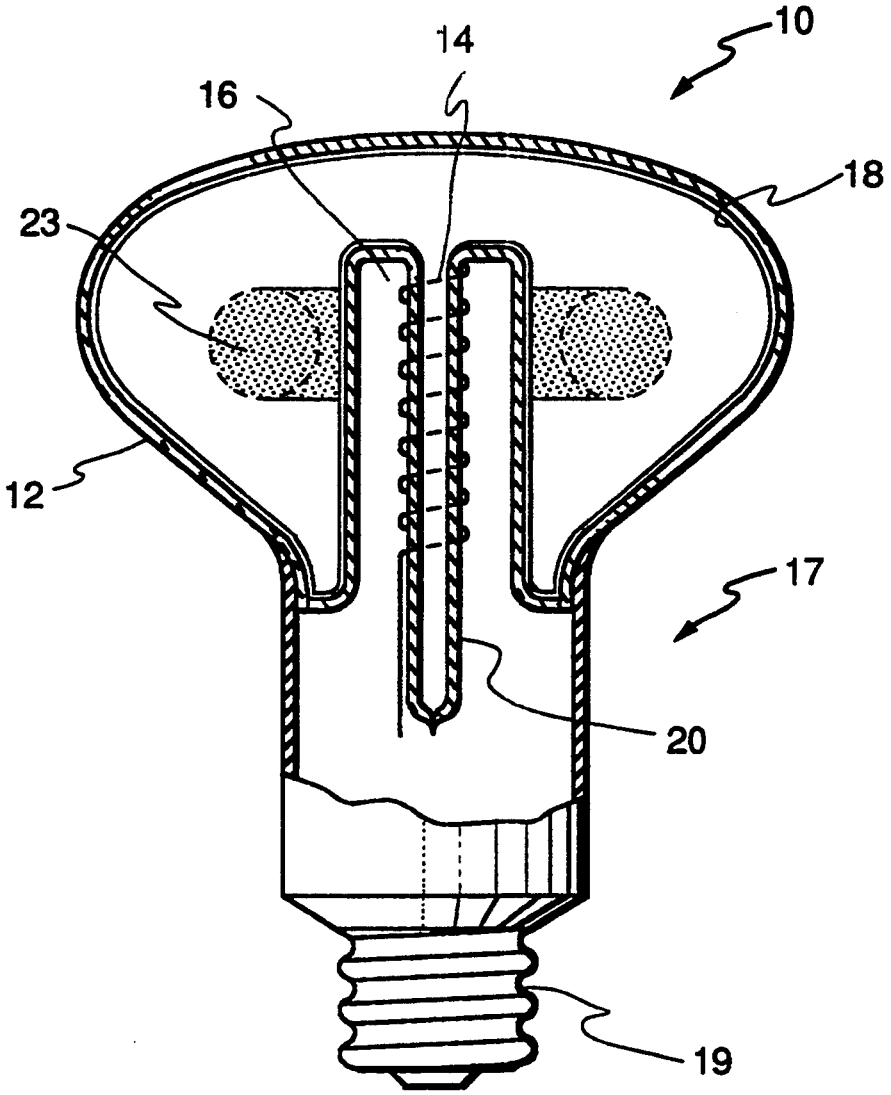
FIG. 1 ( PRIOR ART)
FIG. 1 illustrates, in partial cross section, a typical electrodeless SEF fluorescent lamp.

FIG. 1 illustrates a typical electrodeless SEF fluorescent discharge lamp 10 having an envelope 12 containing an ionizable gaseous fill. A suitable fill, for example, comprises a mixture of a rare gas (e.g., krypton and/or argon) and mercury vapor and/or cadmium vapor. An excitation coil 14 is situated within, and removable from, a re-entrant cavity 16 within envelope 12. For purposes of illustration, coil 14 is shown schematically as being wound about an exhaust tube 20 which is used for filling the lamp. However, the coil may be spaced apart from the exhaust tube and wound about a core of insulating material or may be free standing, as desired. The interior surfaces of envelope 12 are coated in well-known manner with a suitable phosphor 18. Envelope 12 fits into one end of a base assembly 17 containing a radio frequency power supply (not shown) with a standard (e.g., Edison type) lamp base 19 at the other end.

In operation, current flows in coil 14 as a result of excitation by a radio frequency power supply (not shown). As a result, a radio frequency magnetic field is established within envelope 12, in turn creating an electric field which ionizes and excites the gaseous fill contained therein, resulting in an ultraviolet discharge 23. Phosphor 18 absorbs the ultraviolet radiation and emits visible radiation as a consequence thereof.

In accordance with the present invention, a properly constituted amalgam is accurately placed and retained in an optimal location in an SEF lamp for operation at a mercury vapor pressure in the optimum range from approximately four to seven millitorr, which amalgam maintains its composition and location during lamp processing as well as during lamp operation, regardless of lamp orientation. In particular, the amalgam is accurately positioned and retained at a relatively cool location with minimal temperature variation near the apex of the lamp envelope. The apex of the lamp envelope typically comprises the cold spot of the lamp.

An exemplary amalgam comprises a combination of bismuth and indium. Another exemplary amalgam comprises pure indium. Still another exemplary amalgam comprises a combination of lead, bismuth and tin, such as described in commonly assigned U.S. Pat. No. 4,262,231, cited hereinabove. Yet another amalgam may comprise zinc. And yet another amalgam may comprise a combination of zinc, indium and tin. Each amalgam has its own optimum range of operating temperatures.

Figure 2B:
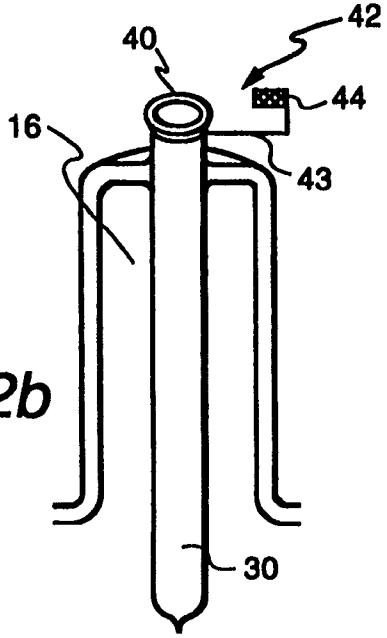
Figure 2A:
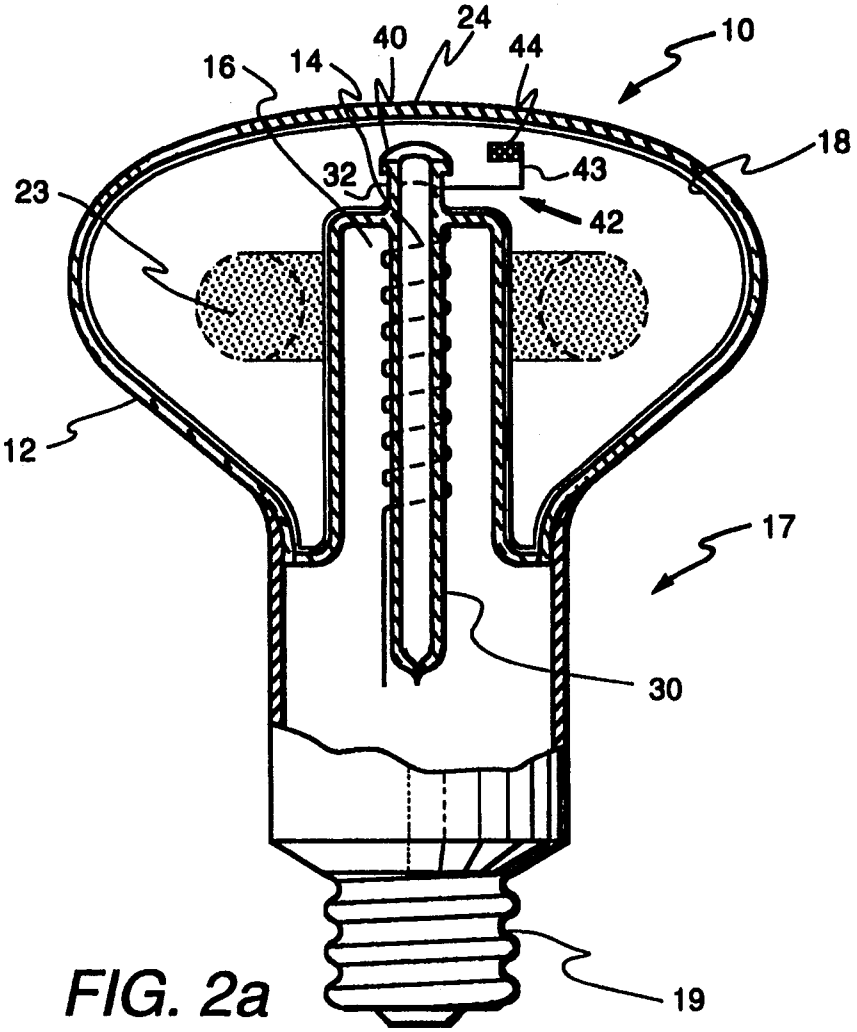

FIGS. 2*a* and 2*b* illustrate an electrodeless SEF lamp in accordance with one embodiment of the present invention. The SEF lamp of FIG. 2 includes an exhaust tube 30 in re-entrant cavity 16 with an extension 32 toward the apex 24 of the lamp. Extension 32 of exhaust tube 30 has a rim portion 40 for positioning an amalgam support 42 in the lamp envelope. Amalgam support 42 is configured to hold an amalgam at a predetermined optimal location in the lamp. The predetermined optimal location depends on the composition of the amalgam and the optimum range of operating temperatures therefor.

In the embodiment of FIG. 2, amalgam support 42 comprises a wire 43 having one end wrapped about exhaust tube extension 32 underneath rim portion 40 and a wire screen 44 at the other end. The amalgam is wetted to wire screen 44. Anderson et al. U.S. Pat. No. 4,262,231, cited hereinabove, describes wetting an amalgam to a wire screen by forming the amalgam into a sheet and heating the sheet in contact with the screen in a hydrogen atmosphere.

Wire 43 of amalgam support 42 may be wrapped entirely around exhaust tube extension 32 underneath rim portion 40, as illustrated in FIGS. 2*a* and 2*b*, or it may be substantially C-shaped for snapping onto exhaust tube extension 32, as illustrated in an enlarged view in FIG. 3.

FIG. 4 illustrates an alternative embodiment of an amalgam support 52 in accordance with the present invention. Amalgam support 52 includes a helical wire structure 54. The amalgam is wetted onto the helical wire structure according to an appropriate method, such as, for example, by the method described in Anderson et al. U.S. Pat. No. 4,262,231, cited hereinabove.

FIG. 5 illustrates another alternative embodiment of an electrodeless SEF fluorescent lamp according to the present invention comprising two amalgams, a starting amalgam 60 and a primary amalgam 62. Starting amalgam 60 is situated near or substantially within the location of the discharge after the lamp has been turned on. In this way, the starting amalgam is heated directly by the discharge, quickly releasing mercury from the starting amalgam upon starting the lamp. As a result, the light output reaches a relatively high level relatively quickly upon starting the lamp.

As shown in FIG. 5, primary amalgam 62 is located at a cooler location than that of starting amalgam 60. Specifically, primary amalgam 62 is situated at an optimal location for operation in its optimum temperature range, thus regulating mercury vapor pressure during steady-state operation of the lamp.

Advantageously, an amalgam positioned in accordance with the present invention does not obstruct the exhaust tube during evacuation and filling of the lamp, allowing for faster lamp processing. In addition, the present invention allows for optimal positioning of both primary and starting amalgams with a single support structure. As still another advantage, no glass-to-metal seal is required to maintain an amalgam at an optimal location within an electrodeless SEF fluorescent lamp during lamp manufacture or operation.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A solenoidal electric field (SEF) fluorescent discharge lamp, comprising:

a light-transmissive envelope containing an ionizable, gaseous fill for sustaining an arc discharge when subjected to a radio frequency magnetic field and for emitting ultraviolet radiation as a result thereof, said envelope having an interior phosphor coating for emitting visible radiation when excited by said ultraviolet radiation, said envelope having an apex portion, said envelope further having a re-entrant cavity formed therein;

an excitation coil contained within said re-entrant cavity for providing said radio frequency magnetic field when excited by a radio frequency power supply; and an exhaust tube extending through said re-entrant cavity, said exhaust tube having an extension into said envelope toward said apex portion of said envelope, said extension having a rim portion for holding an amalgam support in position within said lamp envelope, said amalgam support holding at least one amalgam in a predetermined location within said envelope.

2. The lamp of claim 1 wherein said amalgam support comprises a metal wire, said wire having two ends, one end of said wire being wrapped about said extension of said exhaust tube underneath said rim portion.

3. The lamp of claim 2 wherein said metal wire comprises nickel.

4. The lamp of claim 2 wherein said metal wire comprises steel.

5. The lamp of claim 2 wherein said amalgam support further comprises a wire screen attached to the other end of said wire, said amalgam being wetted to said wire screen.

6. The lamp of claim 2 wherein said amalgam support further comprises a helical wire structure at the other end of said wire, said amalgam being wetted to said helical wire structure.

7. The lamp of claim 1 comprising a starting amalgam and a primary amalgam, said starting amalgam being positioned substantially at the location of said discharge.

8. The lamp of claim 7 wherein said predetermined location of said primary amalgam is optimized for operation of said lamp at a mercury vapor pressure in a range between approximately four to approximately seven millitorr.

9. The lamp of claim 1 wherein said predetermined location of said amalgam is optimized for operation of said lamp at a mercury vapor pressure in a range between approximately four to approximately seven millitorr.

10. The lamp of claim 2 wherein said wire is wrapped entirely about said extension of said exhaust tube underneath said rim portion.

11. The lamp of claim 2 wherein said wire is substantially C-shaped for attaching about said extension of said exhaust tube underneath said rim portion.

* * * * *